US008646452B2

(12) United States Patent
Sklar

(10) Patent No.: US 8,646,452 B2
(45) Date of Patent: Feb. 11, 2014

(54) PEDIATRIC HEADREST FOR SKULL STABILIZATION AND METHOD FOR USE OF SAME

(76) Inventor: Frederick H. Sklar, Waxahachie, TX (US)

( * ) Notice: Subject to any disclaimer, the term of this patent is extended or adjusted under 35 U.S.C. 154(b) by 246 days.

(21) Appl. No.: 13/004,878

(22) Filed: Jan. 11, 2011

(65) Prior Publication Data

US 2011/0168184 A1 Jul. 14, 2011

Related U.S. Application Data

(60) Provisional application No. 61/293,920, filed on Jan. 11, 2010.

(51) Int. Cl.
*A61G 15/00* (2006.01)
*A47B 7/00* (2006.01)

(52) U.S. Cl.
USPC ..... 128/845; 5/622

(58) Field of Classification Search
USPC ..... 128/845–846, 877; 602/17, 32, 33; 5/622, 637, 640, 643; 606/130
See application file for complete search history.

(56) References Cited

U.S. PATENT DOCUMENTS 2,494,792 A 1/1950 Bloom
2,966,383 A 12/1960 Boetcker et al.
3,072,118 A * 1/1963 Standerwick et al. ..... 602/17
3,099,441 A 7/1963 Ries
3,604,412 A 9/1971 Gardner
3,835,861 A 9/1974 Kees et al.
3,923,046 A 12/1975 Heifetz
4,108,426 A 8/1978 Lindstroem et al.
4,169,478 A 10/1979 Hickmann
4,360,028 A 11/1982 Barbier et al.
4,444,179 A 4/1984 Trippi
4,457,300 A 7/1984 Budde
4,465,069 A 8/1984 Barbier et al.
4,545,572 A 10/1985 Day
4,667,660 A 5/1987 Eingorn
5,147,287 A 9/1992 Jewell et al.
5,197,965 A 3/1993 Cherry et al.
5,214,815 A * 6/1993 Agbodoe et al. ..... 5/637
5,254,079 A 10/1993 Agbodoe et al.
5,269,034 A 12/1993 Day et al.
5,276,927 A 1/1994 Day
5,284,129 A 2/1994 Agbodoe et al.
5,317,771 A 6/1994 Cook
5,318,509 A 6/1994 Agbodoe
5,347,894 A 9/1994 Fischer (Continued)

OTHER PUBLICATIONS

International Search Report, PCT/US2011/020906, Mar. 1, 2011.

*Primary Examiner* — Patricia Bianco
*Assistant Examiner* — Ophelia A Hawthorne
(74) *Attorney, Agent, or Firm* — Scott T. Griggs; Griggs Bergen LLP

(57) ABSTRACT

A pediatric headrest for skull stabilization and a method for use of the same are disclosed. In one embodiment, a horseshoe shaped head support includes first and second wings pivotally coupled to a body to adjust the angle therebetween. A gel pad is superposed on the horseshoe shaped head support. First and second arcuate base members are coupled to the first and second wings, respectively, to accept a plurality of placement subassemblies, which are circumferentially adjustably positioned and secured within the channels. Each placement subassembly is configured to receive a skull pin and provide adjustable horizontal, vertical, and angular positioning of the skull pin with respect to the arcuate base.

23 Claims, 3 Drawing Sheets

(56) References Cited

U.S. PATENT DOCUMENTS

| | | | | |
|---|---|---|---|---|
| 5,529,358 | A | 6/1996 | Dinkler et al. | |
| 5,537,704 | A | 7/1996 | Dinkler | |
| 5,564,663 | A | 10/1996 | Cook et al. | |
| 5,674,186 | A | 10/1997 | Guigui et al. | |
| 6,117,143 | A | 9/2000 | Hynes et al. | |
| 6,179,846 | B1 * | 1/2001 | McFadden | 606/130 |
| 6,306,146 | B1 | 10/2001 | Dinkler | |
| 6,315,783 | B1 | 11/2001 | Katz et al. | |
| 6,368,330 | B1 | 4/2002 | Hynes et al. | |
| 6,381,783 | B2 | 5/2002 | Reinhardt et al. | |
| 6,557,195 | B2 * | 5/2003 | Dinkler | 5/601 |
| 6,584,630 | B1 | 7/2003 | Dinkler | |
| 6,629,982 | B2 | 10/2003 | Day et al. | |
| 6,684,428 | B2 | 2/2004 | Grotenhuis et al. | |
| 6,770,082 | B2 | 8/2004 | Dominguez et al. | |
| 7,117,551 | B1 * | 10/2006 | Dinkler et al. | 5/637 |
| 7,229,451 | B2 | 6/2007 | Day et al. | |
| 7,507,244 | B2 | 3/2009 | Dinkler | |
| 7,730,563 | B1 | 6/2010 | Sklar et al. | |
| 2001/0029379 | A1 | 10/2001 | Grotehuis et al. | |
| 2002/0042619 | A1 | 4/2002 | Dominguez et al. | |
| 2002/0151907 | A1 | 10/2002 | Day et al. | |
| 2004/0097985 | A1 | 5/2004 | Day et al. | |
| 2005/0075650 | A1 | 4/2005 | Dinkler | |

* cited by examiner

PEDIATRIC HEADREST FOR SKULL STABILIZATION AND METHOD FOR USE OF SAME

PRIORITY STATEMENT & CROSS-REFERENCE TO RELATED APPLICATIONS

This application claims priority from U.S. Patent Application No. 61/293,920, entitled "Pediatric Headrest for Skull Stabilization and Method for Use of Same" and filed on Jan. 11, 2010, in the name of Frederick H. Sklar; which is hereby incorporated by reference for all purposes.

TECHNICAL FIELD OF THE INVENTION

This invention relates, in general, to pediatric headrests and, in particular, to pediatric headrests for skull stabilization during pediatric neurosurgical and orthopedic procedures and a method for use of the same that involve non-implantable devices.

BACKGROUND OF THE INVENTION

Neurosurgery and orthopedic spine surgery is frequently performed with the head of the patient fixed in a skull clamp for rigid stabilization. Current pin fixation skull clamps are indicated for patients of 5 years and older, although some surgeons claim to use pin fixation on patients as young as 2 years old, despite the risks. In pediatric patients, the skull is thin and elastic. For this reason, traditional impingement methods are not always suitable. Using traditional methods, the force required to hold a child's head—or an elderly adult—sufficiently by pin fixation may deform the skull, penetrate the inner table, or cause compressive fractures of the skull. The need to operate on individuals with these types of skulls necessitates new pediatric headrests that consider the unique requirements of pediatric skulls.

SUMMARY OF THE INVENTION

It would be advantageous to achieve a pediatric headrest for skull stabilization and method for use of the same. It would also be desirable to enable a stabilization solution that considers the demands of pediatric and particular adult skulls. To better address one or more of these concerns, in one aspect of the invention, one embodiment of a pediatric headrest for skull stabilization during pediatric neurosurgical and orthopedic procedures and a method for use of same are disclosed. A horseshoe shaped head support includes first and second wings coupled to a body. The first and second wings are pivotally joined to adjust the angle therebetween. A gel pad is superposed on the horseshoe shaped head support. First and second arcuate base members are coupled to the first and second wings, respectively, to accept a plurality of placement subassemblies, which are circumferentially adjustably positioned and secured within the channels.

Each placement subassembly is configured to receive a skull pin and provide adjustable horizontal, vertical, and angular positioning of the skull pin with respect to the arcuate base. Each of the skull pins is adapted to provide lateral discrete pressure to the skull in order to stabilize the skull. In one implementation, the pediatric headrest is a non-implantable device designed to minimize the amount of pressure imposed on a child's skull for rigid fixation during neurosurgical and orthopedic procedures.

Stabilization and rigid fixation of the skull are provided wherein the skull is supported by a padded weight-bearing device. The pediatric headrest provides increased stability and safety during surgery performed on infants, children, and older patients. In pediatric patients, the forces the skull is subjected to are reduced. Similarly, in older patients, the risk of complications may be reduced, since the weight of the head is not being supported by pins. These and other aspects of the invention will be apparent from and elucidated with reference to the embodiment(s) described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
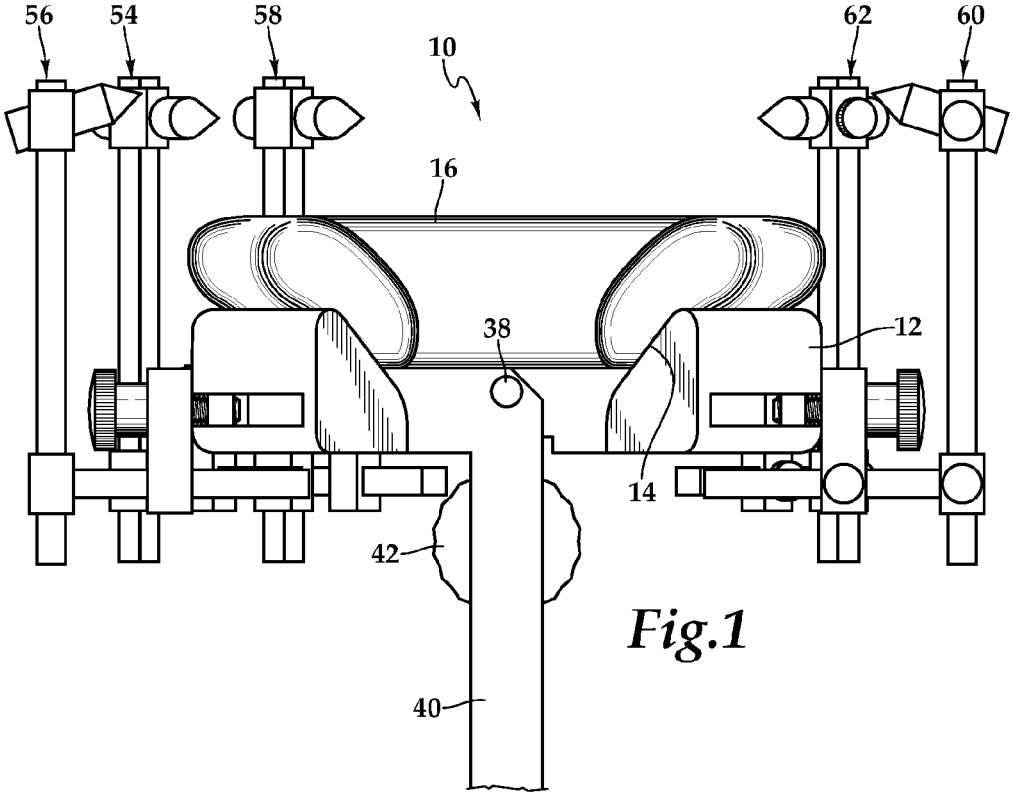
FIG. 1 is a front elevation view of one embodiment of a pediatric headrest for skull stabilization during pediatric neurosurgical and orthopedic procedures.
Figure 2:
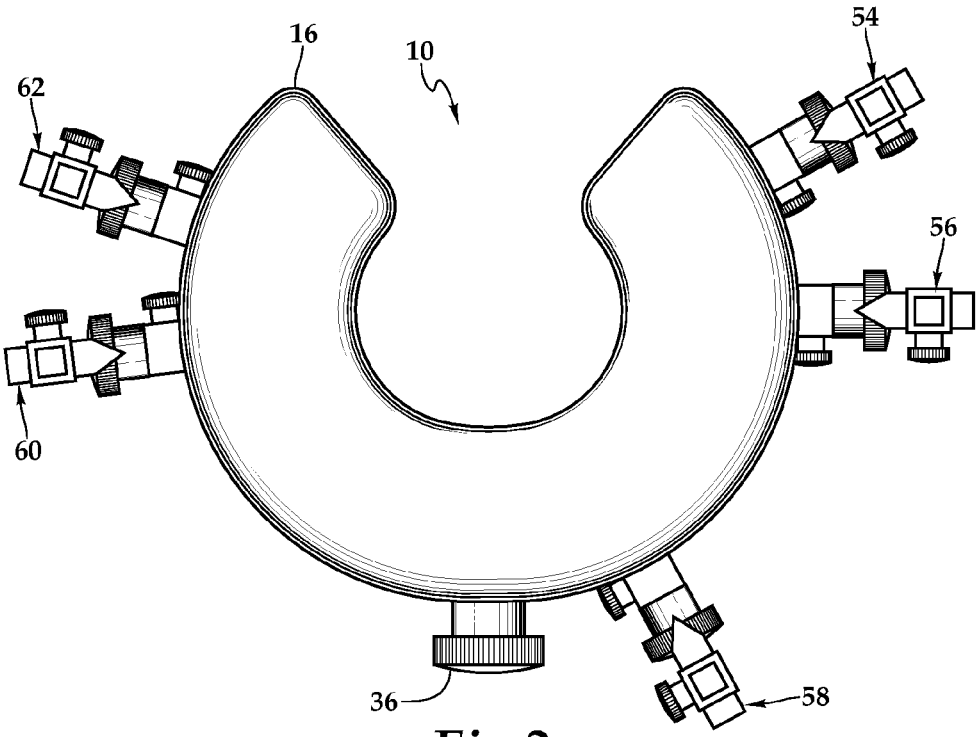
FIG. 2 is top plan view of the pediatric head holder of FIG. 1.
Figure 3:
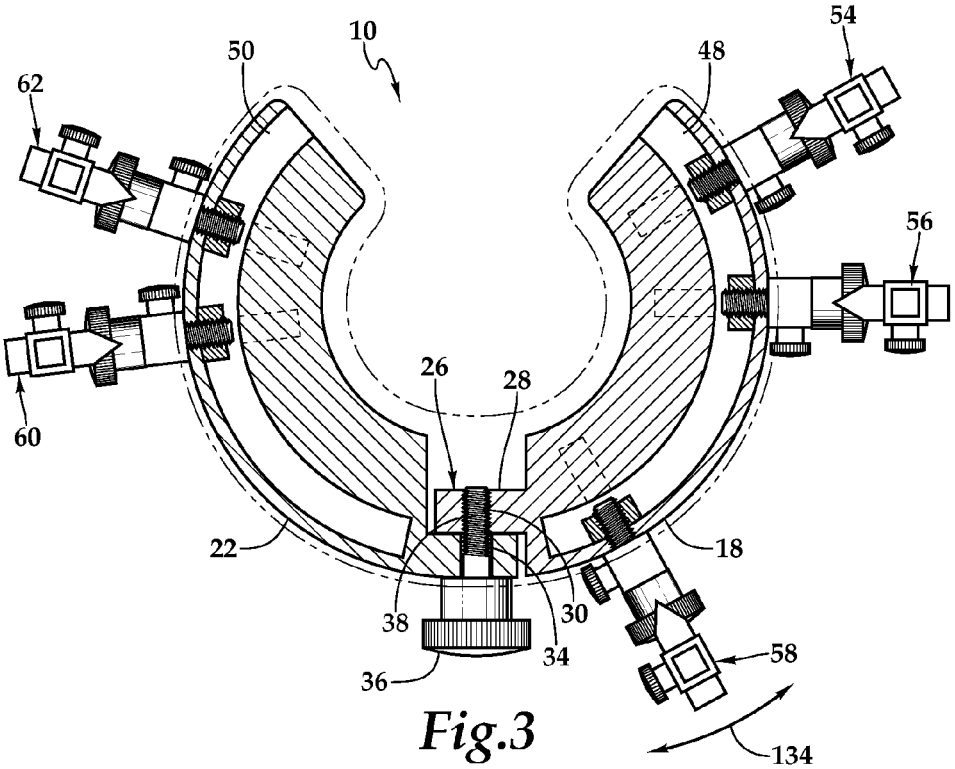
FIG. 3 is a top cross-sectional view of the pediatric head holder of FIG. 1.
Figure 4:
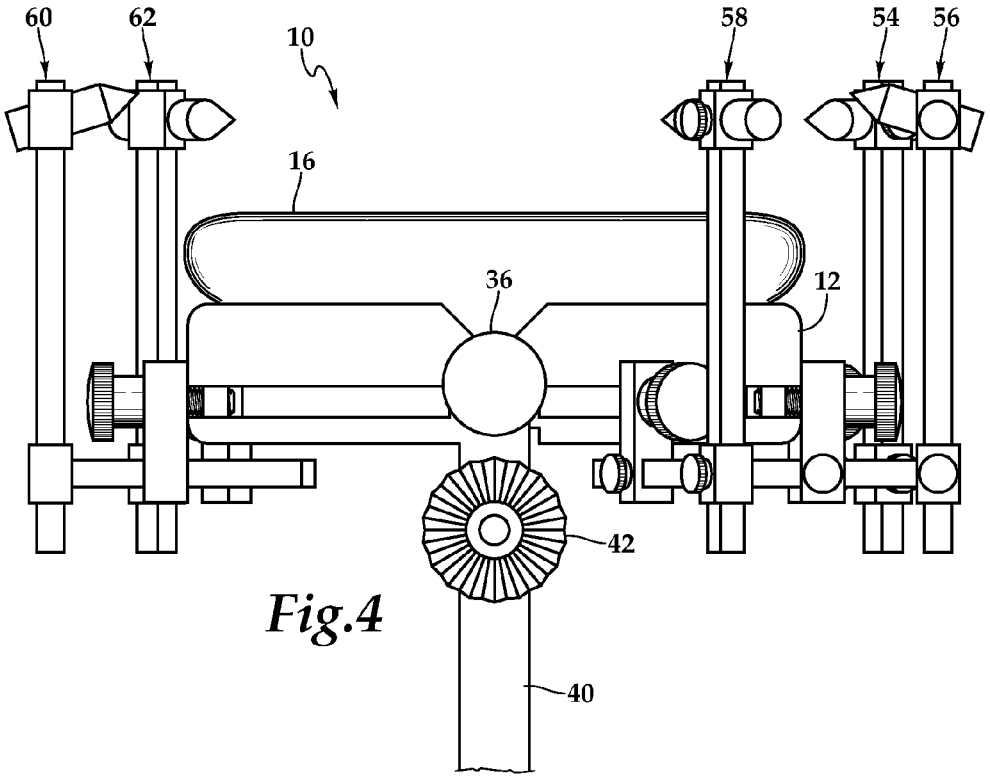
FIG. 4 is a rear elevation view of the pediatric head holder of FIG. 1.
Figure 5:
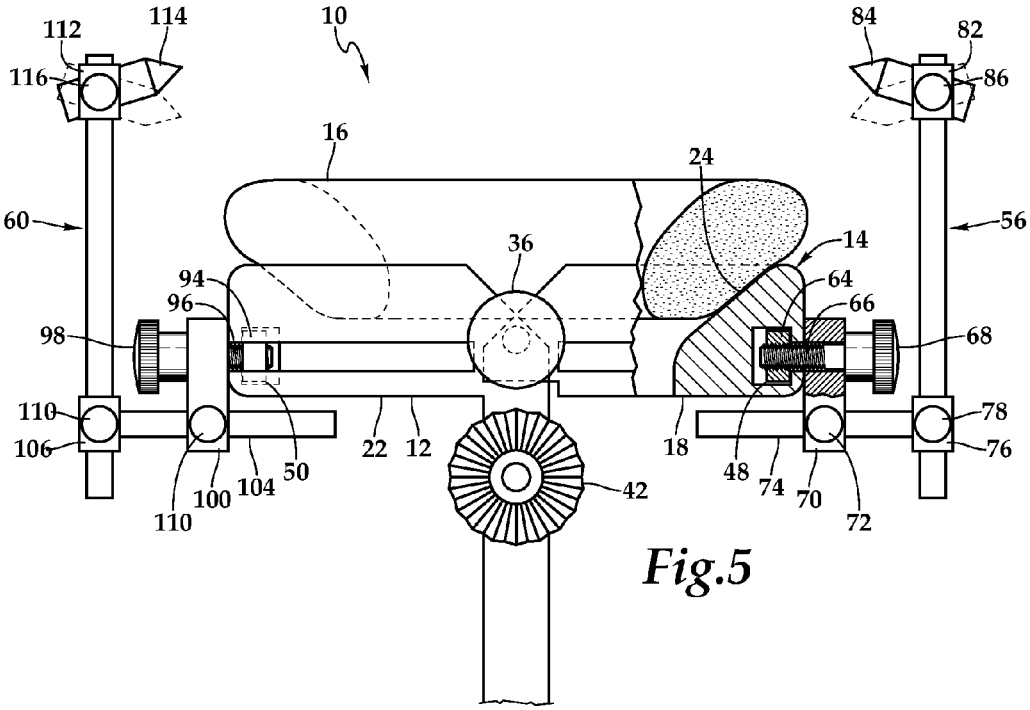
FIG. 5 is a rear cross-sectional view of the pediatric head holder of FIG. 1.
Figure 6:
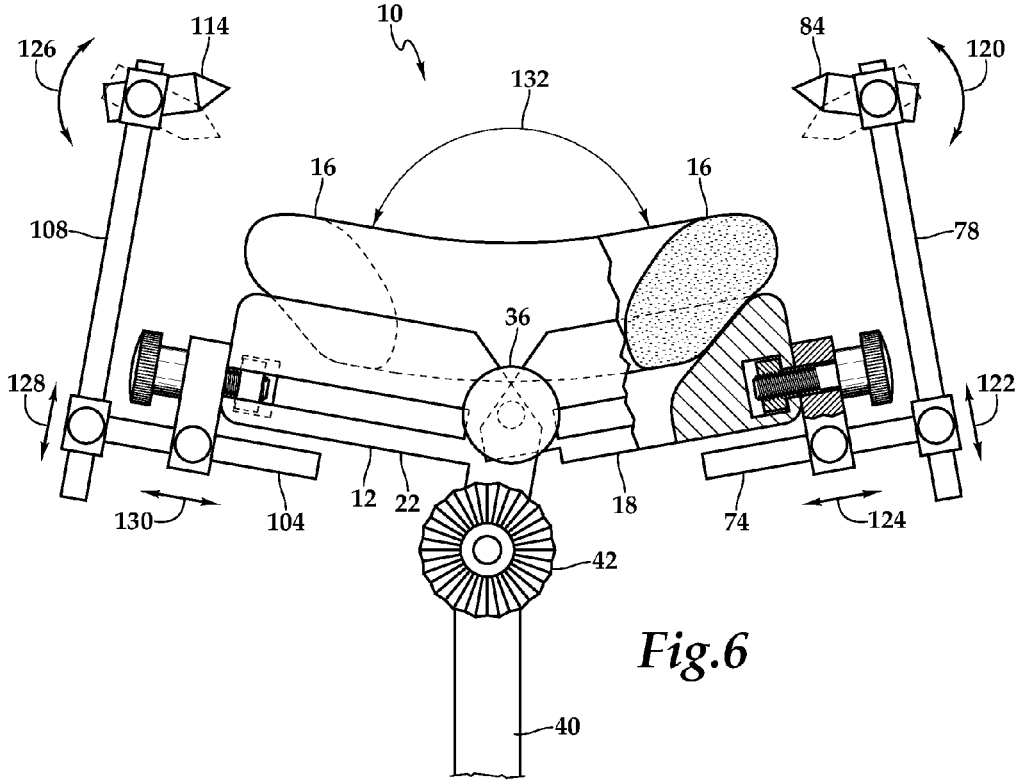
FIG. 6 is a rear cross-sectional view of the pediatric head holder of FIG. 1, wherein the position of the pediatric head holder is being adjusted when compared to FIG. 5.

Referring initially to FIGS. 1 through 6, therein is depicted a pediatric headrest that is schematically illustrated and generally designated 10. A body 12 includes a horseshoe shaped head support 14, which may take the form of a horseshoe shaped gel padded head holder, is adapted to be positioned subjacent to and provide support to the weight of the head or skull with padding in order to prevent deformation. As depicted, an ergonomic gel pad 16 covers the horseshoe shaped head support 14 in order to accept the head or skull and provide discrete pressure. Stainless steel, aluminum, or carbon fiber can be used to make the horseshoe and body components, each furnishing distinct clinical advantages and the selection of which depending on the planned application. Stainless steel provides the most durability. Aluminum reduces the weight of the pediatric headrest. Carbon fiber allows the use of the pediatric headrest with intraoperative MRI scanning.

In one embodiment, the body 12 includes two halves each having an ergonomic curved surface. As shown, wing 18 includes ergonomic curved surface 20 and wing 22 includes ergonomic curved surface 24. A pivot joint 26 is at the interface of the wings 18, 22. Overlapping extension 28 of wing 18 having threaded bore 30 aligns with overlapping extension 32 of wing 22 having threaded bore 30 such that locking knob 36 can selectively loosen and tighten. The locking knob 36 includes threaded fastener 38 extending therefrom for mating with the aligned threaded bores 30, 34.

Upon loosening the locking knob 36 and the threaded fastener 38, the wings 18, 22 are movable to provide a continuous variety of angles therebetween in order to provide a wide range of adjustability to accommodate different sizes of heads and different positions, whether prone, supine, lateral or combinations thereof. When a desired angle 132 between the wings 18, 22 is reached, the locking knob 36 is tightened and the width of the body 12 is thereby set (compare FIGS. 5 and 6). In this way, the pediatric headrest 10 can be adjusted to be used with tiny infants, a distinct advantage over traditional headrests now available. The pediatric headrest 10 may be attached to operating table clamps that are commercially available and in use with other headrests. As shown, however, a support base 40 and knurled female receptacle knob 42 secure the pediatric headrest 10 to the operating table in a variety of positions.

An arcuate base having an arcuate base member 44 and an arcuate base member 46 is coupled to the body such that the arcuate base members 44, 46 at least partially circumscribe a perimeter of the body 12. Respective connection members, which may have the form of channels, slots, recessed slots, or engagement mounting points for example, are located within the arcuate base members 44, 46. As shown channels 48, 50 are depicted. Multiple placement subassemblies 54, 56, 58, 60, 62 are adjustably positioned and secured to the channels 48, 50. Enabled by a series of adjustable clamps and bars, each placement subassembly 54-62 is configured to receive a pin and provide adjustable horizontal, vertical, and angular positioning of the pin with respect to the channels 48, 50. Each of the placement subassemblies, which include a skull pin, is adapted to provide lateral discrete pressure to the skull in order to stabilize the skull. In one implementation, each of the pins comprise skull immobilizing pin subassemblies. In this implementation, stainless steel skull pins are suitable for use with the pin subassemblies. Processing of all components may be by manual or CNC milling and/or lathe operations.

With respect to placement subassembly 54, as shown, the placement subassembly 54 has a locking bar 64 in the form of a dovetail that slides in the channel 48 and a locking screw 66 engages the locking bar 64 by being threaded therein and bearing against the locking bar 64 and channel 48. As the locking screw 66 is tightened, a tight compression fit is developed within the channel 48. The placement subassembly 54 may be moved circumferentially around in the channel 48 to a desired location, and the placement subassembly can be adjusted vertically and horizontally. As shown a pin post carrier 70 selectively tightened by a locking knob 72 supports a horizontal pin post 74 and permits the horizontal pin post to slide to and from the channel 48. With respect to vertical movement, a pin post carrier 76 supports a vertical pin post with knob 80 providing for selective tightening. A skull pin carrier 82 supports skull pin 84, the angle of which may be selectively adjusted by knob 86.

By way of example, placement subassembly 62 includes a locking bar 94, screw 96, and locking knob 98 for circumferential placement of the skull pin 114. A pin post carrier 100, locking knob 102, and horizontal pin post 104 provide horizontal placement of the skull pin 114. A pin post carrier 106, a vertical pin post 108, and a knob 110 furnish vertical placement of the skull pin 114. A skull pin carrier 112 and knob 116 control the angle of skull pin 114. To illustrate this movement, arrow 120 depicts the pivoting of the skull pin 84, arrow 122 depicts the vertical movement of the skull pin 84, and arrow 124 depicts the vertical movement of the skull pin 84. Likewise, arrows, 126, 128, 130 depict similar ranges of movement for the skull pin 114.

In one implementation, three or more placement subassemblies having skull pins can be used to provide immobilization of the head. These subassemblies can be attached to the channels 48, 50 and moved therearound as indicated by arrow 134 to provide ideal pin placement. It should be appreciated that although the number of placement subassemblies and skull pins vary in the drawings, the number of placement subassemblies and pins utilized may vary depending on the application and characteristics of the infant's skull.

In an operational embodiment, for a child, it is desirable to separate the two major functions of a surgical head holder into its basic components: (1) a padded support to carry the weight of the head; and (2) rigid fixation with 3 or more pins that require relatively low force settings. In one embodiment, the pediatric headrest 10 furnishes nearly unrestricted placement of multiple skull pins and the total number of pins is not limited to three as with skull clamps in current use. The use of multiple pins can reduce contact stress levels. In particular, the use of multiple skull pins and the fact that the skull pins are not supporting the weight of the child's head make this headrest safe for use on the thin skulls of infants. This stands in opposition to traditional skull clamps, which support the full weight of the head with pin fixation and high compressive forces. The pediatric headrest disclosed herein does not require high forces to achieve rigid fixation of the pediatric skull. Because the weight of the head is supported by the horseshoe shaped head support and gel pad, relatively low skull pin forces are sufficient to prevent movement of the head. High contact stresses are eliminated.

During surgery, the design of the device allows the surgeon to adjust the padded horseshoe head holder to fit the patient's head and desired operative position. Stabilization hardware can be positioned about the perimeter of the horseshoe headrest. This arrangement permits maximum flexibility of skull pin orientation.

By way of example, initially, the patient is anesthetized. The horseshoe shape head support 14 is fixed to the head end of the operating table, and the patient's head is placed onto the padded support with special attention to avoid pressure on the eyes. The patient may be positioned in a prone, supine, or lateral position or some combination thereof. The skull pins are sterilized per hospital protocol, and the skull pin assembly units are located and fixed circumferentially on the perimeter slots of the headrest. The skull pins are then adjusted to various force levels until sufficient loading produces expected results of limited movement. The surgical site is then prepared and draped, and surgery is performed. Image guidance can be used as necessary. Although the device has been designed primarily for pediatric use, a larger version of the pediatric head hold can be used with older patients and adults with the same advantages as in children. That is, the horseshoe shaped head support may have a size and shape for a child, adolescent, or adult, for example.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A pediatric headrest for skull stabilization during pediatric neurosurgical and orthopedic procedures, the pediatric headrest comprising:

a body;

a horseshoe shaped head support having first and second wings coupled to the body, the horseshoe shaped head support adapted to be positioned subjacent to and to provide support to the weight of the skull, the horseshoe shaped head support configured to accept the skull in a position selected from the group consisting of prone, supine, lateral and combinations thereof;

a gel pad superposed on the horseshoe shaped head support;

the first and second wings being pivotally joined to adjust an angle therebetween;

first and second arcuate base members coupled to the first and second wings, respectively, and at least partially circumscribing a perimeter thereof, each of the first and second arcuate base members having connection members;

a plurality of placement subassemblies adjustably positioned and secured to the connection members of the first and second arcuate base members, each placement subassembly configured to receive a skull pin and provide adjustable horizontal, vertical, and angular positioning of the skull pin with respect to the arcuate base; and each of the skull pins adapted to provide lateral discrete pressure to the skull in order to stabilize the skull.

2. The pediatric headrest as recited in claim 1, wherein the horseshoe shaped head support comprises a size and shape for a child.

3. The pediatric headrest as recited in claim 1, wherein the horseshoe shaped head support comprises a size and shape for an adult.

4. The pediatric headrest as recited in claim 1, wherein the gel pad provides discrete pressure.

5. The pediatric headrest as recited in claim 1, wherein the skull pins comprise three or more skull pins.

6. The pediatric headrest as recited in claim 1, wherein a knurled female receptacle knob extends from the body, the knurled female receptacle knob is configured to secure the pediatric headrest to an operating table.

7. The pediatric headrest as recited in claim 1, wherein the connection members are selected from the group consisting of channels, slots, recessed slots, and engagement mounting points.

8. The pediatric headrest as recited in claim 1, wherein the placement subassemblies further comprise horizontal and vertical pin posts and respective selectively tightenable pin post carriers configured to provide the horizontal and vertical position of the respective skull pin.

9. The pediatric headrest as recited in claim 1, wherein the skull pins are pivotally mounted to the placement subassemblies to provide the angular positioning.

10. The pediatric headrest as recited in claim 1, wherein the skull pins further comprise pins for furnishing low skull pin forces that prevent head movement.

11. A pediatric headrest for skull stabilization during pediatric neurosurgical and orthopedic procedures, the pediatric headrest comprising:

a body;

a horseshoe shaped head support having first and second wings coupled to the body, the horseshoe shaped head support adapted to be positioned subjacent to and to provide support to the weight of the skull, the horseshoe shaped head support configured to accept the skull in a position selected from the group consisting of prone, supine, lateral and combinations thereof;

a gel pad superposed on the horseshoe shaped head support, the gel pad being configured to provide discrete pressure;

the first and second wings being pivotally joined to adjust an angle therebetween;

first and second arcuate base members coupled to the first and second wings, respectively, and at least partially circumscribing a perimeter thereof, each of the first and second arcuate base members having respective channels;

a plurality of placement subassemblies circumferentially adjustably positioned and secured to the respective channels of the first and second arcuate base members, each placement subassembly configured to receive a skull pin and provide adjustable horizontal, vertical, and angular positioning of the skull pin with respect to the arcuate base; and each of the skull pins adapted to provide lateral discrete pressure to the skull in order to stabilize the skull.

12. The pediatric headrest as recited in claim 11, wherein a knurled female receptacle knob extends from the body, the knurled female receptacle knob is configured to secure the pediatric headrest to an operating table.

13. A method for use of a pediatric headrest for skull stabilization during pediatric neurosurgical and orthopedic procedures, the method comprising:

securing the pediatric headrest to an operating table, the pediatric headrest including a horseshoe shaped head support having first and second wings coupled to a body, the horseshoe shaped head support adapted to be positioned subjacent to and to provide support to the weight of the skull, the horseshoe shaped head support configured to accept the skull in a position selected from the group consisting of prone, supine, lateral and combinations thereof;

superposing a gel pad on the horseshoe shaped head support;

adjusting an angle between the first and second wings, the first and second wings being pivotally joined to adjust the angle therebetween;

securing a plurality of placement subassemblies to connection members of first and second arcuate base members, the first and second arcuate base members coupled to the first and second wings, respectively, and at least partially circumscribing a perimeter thereof, each of the first and second arcuate base members having connection members; and adjusting horizontally, vertically, and angularly a respective skull pin associated with each placement subassembly, each of the skull pins being adapted to provide lateral discrete pressure to the skull in order to stabilize the skull.

14. The pediatric headrest as recited in claim 13, wherein securing the pediatric headrest to an operating table further comprises utilizing a knurled female receptacle knob, which extends from the body, to secure the pediatric headrest to an operating table.

15. The pediatric headrest as recited in claim 13, further comprising selectively tightening horizontal and vertical pin post carriers associated with respective horizontal and vertical pin posts to provide the horizontal and vertical position of the skull pins.

16. The pediatric headrest as recited in claim 13, further comprising selecting skull pins that are pivotally mounted to the placement subassemblies to provide the angular positioning.

17. A pediatric headrest for skull stabilization during pediatric neurosurgical and orthopedic procedures, the pediatric headrest comprising:

a body;

a horseshoe shaped head support having first and second wings coupled to the body, the horseshoe shaped head support adapted to be positioned subjacent to and to provide support to the weight of the skull, the horseshoe shaped head support configured to accept the skull in a position selected from the group consisting of prone, supine, lateral and combinations thereof;

a gel pad superposed on the horseshoe shaped head support;

means for adjusting an angle between the first and second wings;

first and second arcuate base members coupled to the first and second wings, respectively, and at least partially circumscribing a perimeter thereof;

means for adjustably positioning a plurality of placement subassemblies adjustably to the connection members of the first and second arcuate base members, each placement subassembly configured to receive a skull pin and provide adjustable horizontal, vertical, and angular positioning of the skull pin with respect to the arcuate base; and each of the skull pins adapted to provide lateral discrete pressure to the skull in order to stabilize the skull.

18. The pediatric headrest as recited in claim 17, wherein a knurled female receptacle knob extends from the body, the knurled female receptacle knob is configured to secure the pediatric headrest to an operating table.

19. The pediatric headrest as recited in claim 17, wherein the placement subassemblies further comprise horizontal and vertical pin posts and respective selectively tightenable pin post carriers configured to provide the horizontal and vertical position of the respective skull pin.

20. The pediatric headrest as recited in claim 17, wherein the skull pins are pivotally mounted to the placement subassemblies to provide the angular positioning.

21. A pediatric headrest for skull stabilization during pediatric neurosurgical and orthopedic procedures, the pediatric headrest comprising:

a body;

a head support adapted to be positioned subjacent to and to provide support to the weight of the skull, the head support configured to accept the skull in a position selected from the group consisting of prone, supine, lateral and combinations thereof;

a base member coupled to the head support and at least partially circumscribing a perimeter thereof, the base member having respective channels;

a plurality of placement subassemblies circumferentially adjustably positioned and secured to the respective channels of the base member, each placement subassembly configured to receive a skull pin and provide adjustable horizontal, vertical, and angular positioning of the skull pin with respect to an arcuate base;

each of the skull pins adapted to provide lateral discrete pressure to the skull in order to stabilize the skull, each of the skull pins being non-weight supporting; and the head support configured to support the weight of the skull and the skull pins configured to provide lateral discrete pressure, thereby stabilizing the skull and separating dual functions of support and fixation.

22. A pediatric headrest for skull stabilization during pediatric neurosurgical and orthopedic procedures, the pediatric headrest comprising:

a body;

a head support adapted to be positioned subjacent to and to provide support to the weight of the skull, the head support configured to accept the skull in a position selected from the group consisting of prone, supine, lateral and combinations thereof;

a base member coupled to the head support and at least partially circumscribing a perimeter thereof, the base member having respective channels;

a plurality of placement subassemblies circumferentially adjustably positioned and secured to the respective channels of the base member, each placement subassembly configured to receive a skull pin and provide adjustable horizontal, vertical, and angular positioning of the skull pin with respect to an arcuate base;

each of the skull pins adapted to provide lateral discrete pressure to the skull in order to stabilize the skull; and the head support configured to support the weight of the skull and the skull pins configured to provide lateral discrete pressure.

23. A pediatric headrest for skull stabilization during pediatric neurosurgical and orthopedic procedures, the pediatric headrest comprising:

a body;

a head support adapted to be positioned subjacent to and to provide support to the weight of the skull, the head support configured to accept the skull in a position selected from the group consisting of prone, supine, lateral and combinations thereof;

a base member coupled to the head support and at least partially circumscribing a perimeter thereof;

a plurality of placement subassemblies circumferentially adjustably positioned and adjustably secured to the base member, each placement subassembly configured to receive a skull pin and provide adjustable horizontal, vertical, and angular positioning of the skull pin with respect to the base member;

each of the skull pins adapted to provide lateral discrete pressure to the skull in order to stabilize the skull, each of the skull pins being non-weight supporting; and the head support configured to support the weight of the skull and the skull pins configured to provide lateral discrete pressure, thereby stabilizing the skull and separating the dual functions of support and fixation.

* * * * *